US007065923B2

(12) United States Patent
Parsadayan et al.

(10) Patent No.: US 7,065,923 B2
(45) Date of Patent: Jun. 27, 2006

(54) METHOD AND APPARATUS FOR BREAKAWAY MOUNTING OF SECURITY GATE TO DRIVE MECHANISM

(75) Inventors: Walter Parsadayan, Lake Forest, CA (US); Wayne C. Hom, Rancho Santa Margarita, CA (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 10/719,991

(22) Filed: Nov. 21, 2003

(65) Prior Publication Data

US 2004/0149977 A1 Aug. 5, 2004

Related U.S. Application Data

(63) Continuation of application No. 09/846,560, filed on Apr. 24, 2001, now abandoned.

(51) Int. Cl.
*E05B 65/10* (2006.01)
*E01F 13/00* (2006.01)
*E01F 9/00* (2006.01)

(52) U.S. Cl. ..... 49/141; 49/49; 404/9; 404/10

(58) Field of Classification Search ..... 49/139, 49/49, 141, 1, 50; 404/6, 9, 10; 403/2; 52/98, 52/99; 256/1, 13.1
See application file for complete search history.

(56) References Cited

U.S. PATENT DOCUMENTS 3,394,498 A * 7/1968 Reinitz et al. ..... 49/141
4,364,200 A * 12/1982 Cobb ..... 49/49
4,531,325 A * 7/1985 Phillips ..... 49/49
4,897,960 A * 2/1990 Barvinek et al. ..... 49/49
4,970,826 A * 11/1990 Richmond et al. ..... 49/139
5,288,164 A * 2/1994 Nasatka ..... 404/10
5,671,563 A * 9/1997 Marcum ..... 49/49
5,884,432 A * 3/1999 DeLillo ..... 49/49
6,212,825 B1 * 4/2001 Hopkins, Jr. ..... 49/49

* cited by examiner

*Primary Examiner*—Hugh B. Thompson, II
(74) *Attorney, Agent, or Firm*—Fitch, Even, Tabin & Flannery

(57) ABSTRACT

A method and apparatus for operating a security gate is disclosed which may comprise a drive mechanism arm having a first end and a second end, and including a security gate attachment member connected to the first end of the drive mechanism arm; a drive mechanism actuator operatively connected directly or indirectly to the drive mechanism arm and adapted to move the drive mechanism arm along a predefined path in relation to the actuator in response to operation of the actuator; and a release mechanism adapted to release the connection of the security gate attachment member to the first end of the drive mechanism arm in response to the application of a force to the security gate attachment member in a direction other than the force applied to the security gate attachment member by the drive mechanism arm in response to the operation of the actuator to move the security gate drive mechanism arm along the predefined path. The apparatus and method may also include a retractor to retract the drive arm after disconnection. The apparatus and method may have an actuator is a linear motion actuator connected directly to the drive mechanism arm, or a rotary motion actuator indirectly connected to the drive mechanism arm.

26 Claims, 2 Drawing Sheets

METHOD AND APPARATUS FOR BREAKAWAY MOUNTING OF SECURITY GATE TO DRIVE MECHANISM

This application is a continuation of application Ser. No. 09/846,560 filed Apr. 24, 2001, now abandoned.

FIELD OF THE INVENTION

The present invention relates to the field of security gate driving mechanisms and more specifically to a method and apparatus for providing breakaway protection for a security gate drive mechanism.

BACKGROUND OF THE INVENTION

It is known to provide security gates that a driven by a motor operated control arm that may be articulated or linear in nature. Commonly, a drive mechanism may be severely damaged if the gate is prevented from being moved in the direction that the drive mechanism is trying to move the gate, e.g., if some obstacle, like a vehicle, is blocking the intended movement of the security gate. In addition, even if the gate is not currently in motion and being driven by the gate driving mechanism, the gate may be forced into unintended movement, as, e.g., by a collision with a vehicle, e.g., attempting to breach the security gate and gain unauthorized ingress or egress. Under these circumstances, the security gate drive mechanism may be bent or broken, e.g., by the arm being bent of the drive screw for a linear drive mechanism becoming bent or broken. In addition, the driving motor attached to the gate may be broken. This is particularly a problem with security gate drive mechanisms that swing a security gate from an open position to a closed position and vice-versa. There is, therefore, a need for a method and apparatus for protecting the security gate drive mechanism from such damage.

SUMMARY OF THE INVENTION

DETAILED DESCRIPTION OF THE PREFERRED EMBODIMENTS

Figure 1:
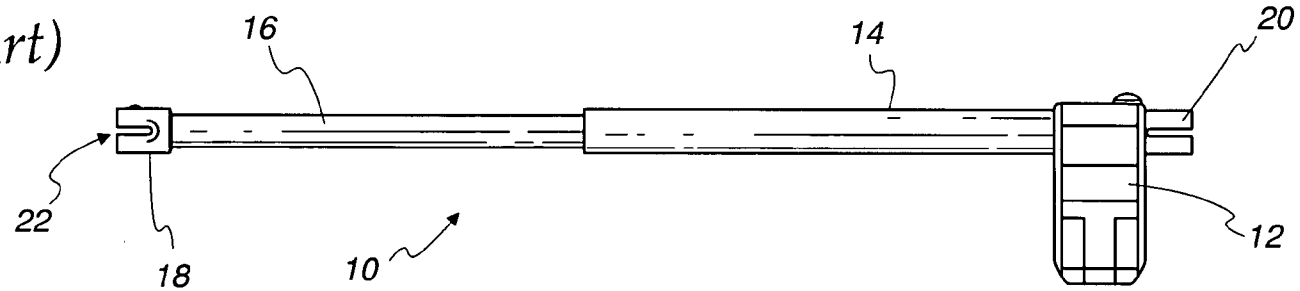
Fig. 1 (Prior Art)
FIG. 1 shows a perspective view of an example of a known security gate drive mechanism.

Turning now to FIG. 1 there is shown a known example of a security gate operating mechanism 10 according to the prior art. The security gate operating mechanism can include a drive motor housing 12, which can contain a drive motor (not shown) for example an electrically driven rotating gear motor that can drive a threaded screw (not shown) contained within a generally tubular housing 14 an extensible arm 16 may be driven by the threaded screw, e.g., by being attached to a carriage (not shown) that moves along the threaded screw in response to the rotation of the rotating gear of the motor. Attached essentially rigidly to the distal end of the extensible arm 16 may be a gate attachment member 18, which may have a slot 22 for receiving a security gate attachment bracket (not shown) that can be mounted on the security gate, and can be rotatably attached to the security gate attachment bracket, e.g., by an attachment bolt that extends through a hole (not shown) in the attachment member 18 and a hole (not shown) in the attachment bracket. As noted above, if an untoward force is applied to the security gate, as by a collision with a vehicle while the gate is in motion in the closing or opening direction, or when while the gate is in a stationary position, can cause the extensible arm 16, the tubular housing 14, the threaded screw shaft and/or the drive motor to be bent or otherwise damaged. In addition, even if the force is sufficient to cause the attachment member 18 to become separated from the gate, the operating mechanism, and particularly the extensible arm can remain in the vicinity of the security gate and become entangled in the gate as it is driven by the untoward force, or be struck by the cause of the exertion of the force, e.g., a vehicle in collision or formerly in collision with the security gate.

Figure 2:
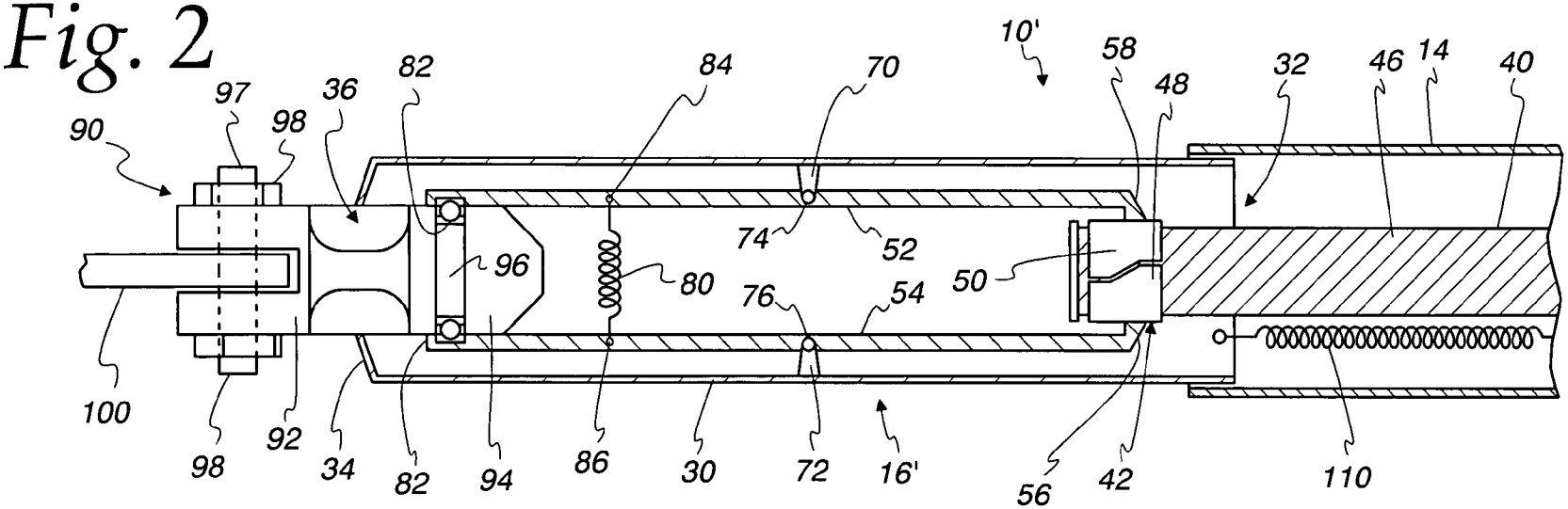
FIG. 2 shows a partially cross sectional view along a plane in the plane of the paper as shown in FIG. 1 of a modification of the security gate drive mechanism shown in FIG. 1, according to one possible embodiment of the present invention.

Turning now to FIG. 2 there is shown a partially cross sectional view along a plane in the plane of the paper as shown in FIG. 1 of a modification of the security gate drive mechanism 10 shown in FIG. 1, to form a security gate drive mechanism 10' according to one possible embodiment of the present invention. The embodiment of FIG. 2 can have a generally tubular housing 14 within which is slideably housed an extensible arm 16' according to the embodiment of FIG. 2. The extensible arm 16' can have a generally tubular sleeve 30. The generally tubular sleeve 30 can be in telescoping relation to the housing 14 and can have an open end 32. Into the open end 32 can extend a threaded screw 40, which is driven to rotate by a drive motor (not shown) positioned generally at the opposite end of the generally tubular housing 14 from that shown in FIG. 2. The threaded screw 40 may have threads 46. At the distal end of the sleeve 30 there may be formed by a rim 34 extending inwardly from the circumference of the tubular sleeve top form a distal end opening 36.

Releasably attached to the threaded screw 40, can be a moving carriage 42. The moving carriage 42 can have internal threads (not shown) that can be threadedly engaged by the threads 46 on the threaded screw 40. The carriage 42 may be made detachable from the threaded engagement with the threads 46 of the threaded screw 40, e.g., by being formed of two generally semicircular halves 48 and 50, which can be disengaged from the threaded engagement with the threads 46, as explained in more detail below. Also included within the extensible arm sleeve 30 and attached to the respective halves of the carriage 42 may be extensible arm 16' drive rods 52 and 54, each of which is attached to its respective half of the carriage, 50, 48, by an attachment 58, 56. The attachment may be, e.g., by way of welding the end of the respective drive rod 52, 54 to the respective half 50, 48 of 30 the carriage 42.

Extending from the interior wall of the sleeve 30 can be a pair of pivot brackets 70, 72. to each respective pivot bracket 70, 72 may be pivotally attached a respective drive rod 52, 54, as, e.g., by a respective pivot pin 74, 76, passing through a hole (not shown) in the respective drive rod 52, 54 and through the respective pivot bracket 70, 72. A compression spring 80 may be attached to each of the drive rods 52, 54 at its respective ends 84 and 86.

The security gate drive mechanism 10' of FIG. 2 may have a gate attachment member 90. The gate attachment member 90 can attach the security gate drive mechanism to the security gate (not shown), as, e.g., by attachment to an attachment bracket 100 mounted on the security gate. The gate attachment member 90 may include a generally cylindrical attachment rod 92. The generally cylindrical attachment rod 92 can have a head 94. The head 94 is sized and shaped to conveniently be inserted into the interior of the sleeve 30 through the distal end opening 36. Displaced from the head in a direction toward the exterior of the sleeve 30 through the distal end opening 36 can be a detent groove 96. In addition, the attachment member 90 may have an attachment bolt 87 and a pair of attachment nuts 98. The attachment bolt may extend through a hole in the attachment member 90 and the gate mounting bracket 100 and be held in place by the nuts 98. Each of the drive rods 52, 54 can have mounted on the distal ends thereof a detent 82, adapted to be engaged within the detent groove 96.

In the operation of the embodiment of FIG. 2, with the application to the security gate of an untoward force, e.g., a force other than in the direction in which the security gate operating mechanism is applying force to the security gate, i.e., in the embodiment of FIG. 2, generally along the axis of rotation of the threaded screw 40, which coincides generally with the axis of motion of the sleeve 30 and the drive rods 52, 54, the detents 82, or at least initially one of the detents 82, will become disengaged from the detent groove 96. Once the detents 82 are disengaged from the groove 96, the attachment rod 92 can be withdrawn through the distal end opening 36 responsive to the untoward force, and the spring action from the compression spring 80 can pivot the drive rods 52 and 54 about the pivot points 74, 76. This pivoting of the drive rods 52, 54 about the pivot points 74, 76 can serve to disengage the respective halves 50, 48 of the carriage 42 from threaded engagement with the threads 46 of the threaded screw shaft 40. This in turn can allow a retraction spring 110, attached to the sleeve 30 to retract the sleeve and the drive rods 52, 54 back within the housing 14. A limit switch (not shown) in the vicinity of the drive motor can be set to sense the retraction of the sleeve 30, indicating a disengagement of the drive mechanism 10' from operative connection to the security gate. Detection of disengagement from the security gate can serve to initiate a number of safety features by the security gate controller (not shown), e.g. turning off the security gate operating mechanism 10' drive motor, if it is in operation.

Figure 3:
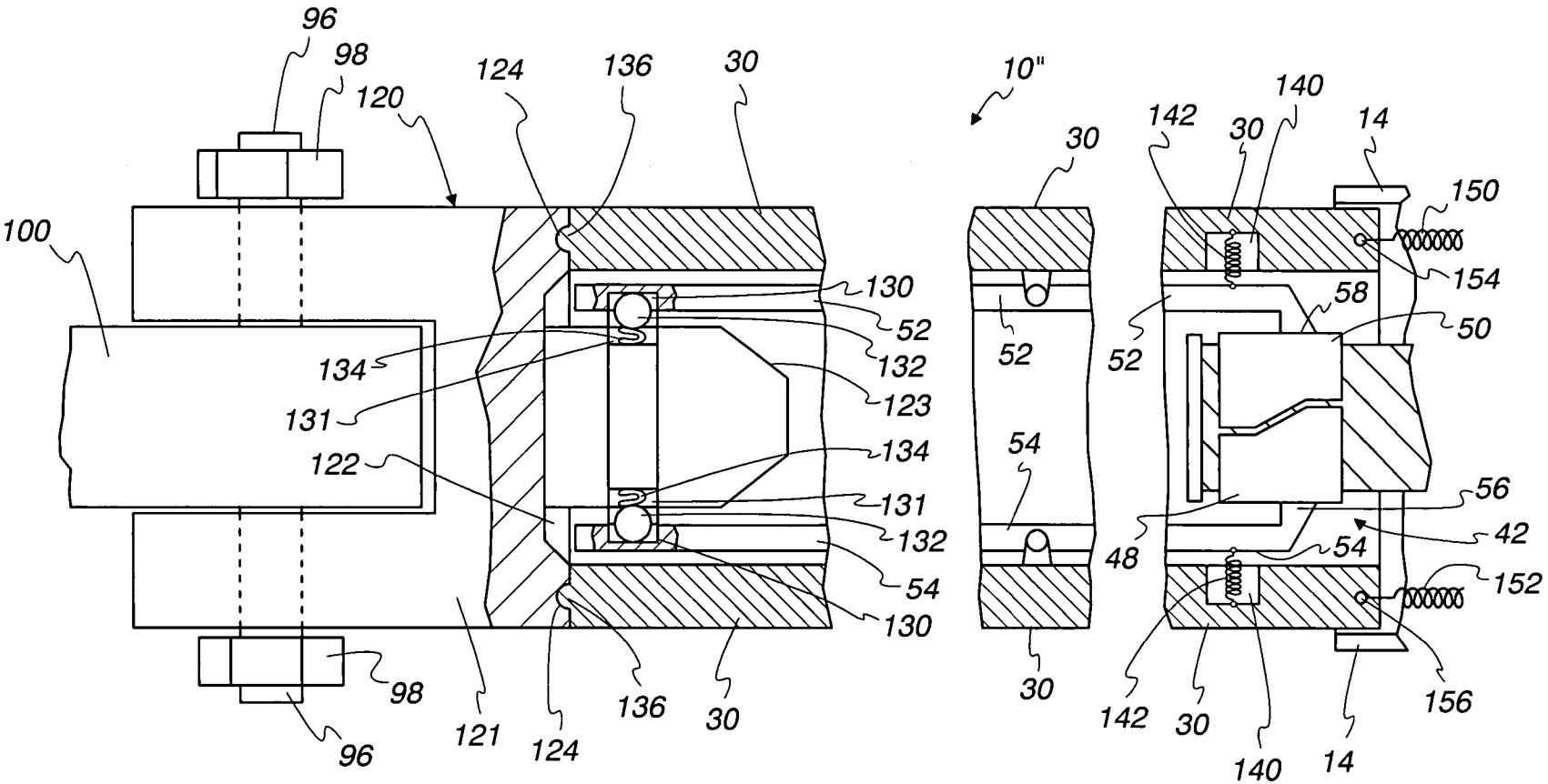
FIG. 3 shows a partially cross-sectional, in a plane similar to that of FIG. 2, and partially cut-away view of another possible embodiment of the present invention.

Turning now to FIG. 3 there is shown another possible embodiment of the present invention. As shown in FIG. 3, a security gate operating mechanism 10" may include a gate attachment member 120. The gate attachment member 120 may include a generally cylindrical body 121. The generally cylindrical body 121 may include a generally circular recess 122. Protruding from the generally circular recess can be a generally cylindrical rod 123. The generally cylindrical body 121 may have formed on a circular ring surrounding the generally circular recess 122, a ring groove 124. The sleeve 30 may have a corresponding ring knob that engages and aligns the attachment member 120 with the sleeve 30.

Contained within the rod 123 can be a pair of opposing detent spring recesses 131. Similarly, at generally the distal ends of each of the drive rods 52, 54, can be a detent ball recess 130. A detent ball 132 and a detent compression spring 134 can be associated with the respective recesses 130, 131. It will be understood by those skilled in the art that the relative positions of the detent spring 134 and ball 132 can be reversed. Also shown in FIG. 3 at the opposite end of the sleeve 30 is a pair of respective tension spring 142 recesses 140. Each tension spring 142 may be attached to the respective drive rod 52, 54 generally in the vicinity of the carriage 42. In the embodiment of FIG. 3 there is shown a pair of retractor springs 150,152, each attached to the sleeve 30 by a respective attachment 154, 156.

In operation of the embodiment of FIG. 3, upon application of an untoward force the detent ball and spring connection between the drive rods 52, 54 and the attachment member 120 will become detached and the retractor springs will retract the drive rods 52, 54 and the sleeve 30 upon detachment of the threaded engagement of the carriage halves 48, 50. The tension springs 142 pull the respective halves 48, 50 out of threaded engagement. In, all other respects, the operation is as in accordance with FIG. 2.

While the preferred embodiments of the present invention have been shown and described, it will be apparent to those skilled in the art that various modifications may be made in these embodiments without departing from the spirit of the present invention. For example, preferred embodiments of the present have been illustrated including linear security gate drive mechanisms and threaded screw drive motors, however, the concepts of the present invention are equally applicable with non-linear drive mechanisms, including those where the drive arm that is actually connected to the security gate may be indirectly connected to the driving motor, and with other forms of drive motors. For that reason, the scope of the invention is set forth in the following claims.

We claim:

1. A security gate operating mechanism, comprising:

a drive mechanism arm having a first end and a second end;

a security gate attachment member adapted to connect to a security gate;

a drive mechanism actuator operatively connected directly or indirectly to the drive mechanism arm and adapted to move the drive mechanism arm along a predefined path in relation to the actuator in response to operation of the actuator;

a release mechanism releasably connecting the security gate attachment member and the first end of the drive mechanism arm and adapted to release the connection of the security gate attachment member from the first end of the drive mechanism arm in response to the application of a force to the security gate attachment member in a direction other than the force applied to the security gate attachment member greater than a predetermined force such that the release mechanism before and after the act of releasing is structurally the same.

2. The apparatus of claim 1 wherein the actuator is a linear motion actuator and is connected to the drive mechanism arm.

3. The apparatus of claim 1 wherein the actuator is a rotary motion actuator and is connected to the drive mechanism arm.

4. A security gate operating mechanism, comprising:

a security gate drive arm having a first end and a second end, with the first end pivotally attached to a security gate at a pivot point, having a pivot axis, by a pivotal attachment member;

a drive mechanism connected to the drive arm and adapted to drive the drive arm for movement of the pivot axis through an arc of movement of the security gate through the application of a force to the security gate by the drive arm generally in a plane perpendicular to the pivot axis and generally aligned with a tangent to the arc of swinging movement of the pivot point at any given point of swinging movement of the security gate;

a breakaway mounting, included as part of the pivotal attachment member and responsive to application of a force either outside of the swinging plane or unaligned with the tangent of the arc of swinging movement of the pivot point at any given point of swinging movement of the security gate, adapted to disconnect the security gate drive arm from its attachment to the security gate; and, a security gate drive arm retractor connected to the security gate drive arm, having a retractor mechanism, and responsive to the disconnection of the security gate drive arm from its connection to the security gate, adapted to retract the security gate drive arm in a direction away from the attachment member.

5. The apparatus of claim 4, further comprising:

a drive mechanism interconnect connecting the security gate drive arm directly or indirectly to the drive mechanism;

a disconnecting mechanism forming a part of the drive mechanism interconnect and, responsive to the disconnect of the security gate drive arm from its connection to the security gate, adapted to disable the application of driving force to the security gate drive arm by the driving mechanism, allowing the drive arm retractor mechanism to retract the drive arm.

6. The apparatus of claim 5 wherein the drive arm retractor mechanism includes a spring attached directly or indirectly to the drive arm.

7. The apparatus of claim 5 wherein the drive arm retractor includes at least one switch adapted to remove the driving force from the security gate drive arm and allow retraction of the security gate drive arm.

8. The apparatus of claim 5 wherein the drive mechanism includes a threaded shaft having a drive carriage, threadably mounted thereon, for movement along the threaded shaft in response to rotation of the threaded shaft, in operative connection with the security gate drive arm.

9. The apparatus of claim 5, wherein the drive mechanism includes a chain drive having a sprocket driven in a rotary motion about a sprocket pivot axis, and drivingly attached to a sprocket in operative connection with the security gate drive arm.

10. The apparatus of claim 5 wherein the drive mechanism is a threaded screw.

11. The apparatus of claim 5 wherein the drive mechanism is a chain drive.

12. The apparatus of claim 5 wherein the drive mechanism is a hydraulic piston.

13. A security gate operating mechanism, comprising:

drive means, including a drive arm, having a first end and a second end;

a security gate attachment means for connection to a security gate;

actuating means, operatively connected to the drive arm, for moving the drive arm along a predefined path in relation to the actuating means in response to operation of the actuating means;

releasing means for releasing the connection of the security gate attachment means from the first end of the drive arm in response to the application of a force to the security gate attachment member greater than a predetermined force such that the releasing means before and after the act of releasing is structurally the same.

14. The apparatus of claim 13 wherein the actuating means is a linear motion actuator.

15. The apparatus of claim 13 wherein the actuating means is a rotary motion actuator.

16. A security gate operating means, comprising:

a security gate drive arm having a first end and a second end;

a drive means connected to the drive arm for driving the drive arm for movement of the pivot axis through an arc of movement of the security gate through the application of a force to the security gate by the drive arm generally in a plane perpendicular to the pivot axis and generally aligned with a tangent to the arc of swinging movement of the pivot point at any given point of swinging movement of the security gate;

breakaway mounting means, included as part of the pivotal attachment member and responsive to application of a force either outside of the swinging plane or unaligned with the tangent of the arc of swinging movement of the pivot point at any given point of swinging movement of the security gate, for disconnecting the security gate drive arm from its attachment to the security gate; and, security gate drive arm retractor means connected to the security gate drive arm, having a retractor mechanism, and responsive to the disconnection of the security gate drive arm from its connection to the security gate, for retracting the security gate drive arm in a direction away from the attachment member.

17. The apparatus of claim 16, further comprising:

drive means interconnect means connecting the security gate drive arm directly or indirectly to the drive means;

disconnecting means forming a part of the drive means interconnect means, for, responsive to the disconnect of the security gate drive arm from its connection to the security gate, disabling the application of driving force to the security gate drive arm by the driving means, allowing the drive arm retractor means to retract the drive arm.

18. The apparatus of claim 17 wherein the drive arm retractor means includes a spring attached directly or indirectly to the drive arm.

19. The apparatus of claim 17 wherein the drive arm retractor means includes at least one switch adapted to remove the driving force from the security gate drive arm and allow retraction of the security gate drive arm.

20. The apparatus of claim 17 wherein the drive means includes a threaded shaft having a drive carriage, threadably mounted thereon, for movement along the threaded shaft in response to rotation of the threaded shaft, in operative connection with the security gate drive arm.

21. The apparatus of claim 17, wherein the drive means includes a chain drive having a sprocket driven in a rotary motion about a sprocket pivot axis, and drivingly attached to a sprocket in operative connection with the security gate drive arm.

22. A method of operating a security gate, comprising:

driving the security gate with a drive arm, having a first end and a second end, and including a security gate attachment member connected to the first end of the drive arm;

actuating the drive arm by operatively connecting the drive arm directly or indirectly to an actuating mechanism, and moving the drive arm along a predefined path in relation to the actuating mechanism in response to operation of the actuating mechanism;

releasing the connection of the security gate attachment member to the first end of the drive means arm in response to the application of a force to the security gate attachment member in a direction other than the force applied to the security gate attachment member by the drive arm in response to the actuation of the drive arm to move the security gate drive arm along the predefined path such that the security gate attachment member and the first end of the drive means arm before and after the act of releasing are structurally the same.

23. The method of claim 22 wherein the step of actuating is done with a linear motion actuator.

24. The apparatus of claim 22 wherein the step of actuating is done with a rotary motion actuator.

25. A method of operating a security gate, comprising:

driving the security gate with a security gate drive arm having a first end and a second end, with the first end pivotally attached to the security gate at a pivot point, having a pivot axis, by a pivotal attachment member;

actuating the drive arm by driving the drive arm for movement of the pivot axis through an arc of movement of the security gate by the application of a force to the security gate by the drive arm generally in a plane perpendicular to the pivot axis and generally aligned with a tangent to the arc of swinging movement of the pivot point at any given point of swinging movement of the security gate;

disconnecting, responsive to application of a force to the drive arm, either outside of the swinging plane or unaligned with the tangent of the arc of swinging movement of the pivot point at any given point of swinging movement of the security gate, the security gate drive arm from its attachment to the security gate; and, retracting the security gate drive arm, responsive to the disconnection of the security gate drive arm from its connection to the security gate.

26. The method of claim 25, further comprising:

providing a drive interconnect connecting the security gate drive arm directly or indirectly to the drive means;

responsive to the disconnect of the security gate drive arm from its connection to the security gate, disabling the application of driving force to the security gate drive arm, allowing the retraction of the drive arm.

* * * * *